US012583567B2

(12) United States Patent
Amma

(10) Patent No.: US 12,583,567 B2
(45) Date of Patent: Mar. 24, 2026

(54) SMALL MARINE VESSEL CAPABLE IN WHICH ACTION POSITION OF THRUST FORCE IS CHANGEABLE

(71) Applicant: YAMAHA HATSUDOKI KABUSHIKI KAISHA, Iwata (JP)

(72) Inventor: Hirofumi Amma, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 428 days.

(21) Appl. No.: 18/198,470

(22) Filed: May 17, 2023

(65) Prior Publication Data

US 2023/0399090 A1 Dec. 14, 2023

(30) Foreign Application Priority Data

Jun. 9, 2022 (JP) ..... 2022-094002

(51) Int. Cl.
*B63H 20/10* (2006.01)
*B63H 20/00* (2006.01)

(52) U.S. Cl.
CPC ..... *B63H 20/10* (2013.01); *B63H 2020/003* (2013.01)

(58) Field of Classification Search
CPC ..... B63H 20/10; B63H 2020/003
See application file for complete search history.

(56) References Cited

U.S. PATENT DOCUMENTS

| | | | | |
|---|---|---|---|---|
| 4,077,353 | A * | 3/1978 | Webb, Jr. | B63H 20/10 248/641 |
| 5,006,083 | A | 4/1991 | Sumigawa | |
| 9,862,473 | B2 * | 1/2018 | Rydberg | B63B 39/00 |
| 2015/0232162 | A1 * | 8/2015 | Kinpara | G05G 5/20 440/6 |
| 2020/0108902 | A1 * | 4/2020 | Wong | B63H 25/02 |
| 2022/0289341 | A1 * | 9/2022 | Gai | B63B 21/26 |

FOREIGN PATENT DOCUMENTS

JP 01-317893 A 12/1989

* cited by examiner

*Primary Examiner* — Stephen P Avila
(74) *Attorney, Agent, or Firm* — Keating & Bennett, LLP

(57) ABSTRACT

A small marine vessel includes a hull and an outboard motor attached to the hull to be rotatable about a first axis extending along a front-rear direction of the hull and to be movable in an up-down direction of the hull so as to more actively contribute to the maneuverability of the small marine vessel.

18 Claims, 11 Drawing Sheets

SMALL MARINE VESSEL CAPABLE IN WHICH ACTION POSITION OF THRUST FORCE IS CHANGEABLE

CROSS REFERENCE TO RELATED APPLICATIONS

This application claims the benefit of Japanese Patent Application No. 2022-94002, filed on Jun. 9, 2022, which is hereby incorporated by reference herein in its entirety.

BACKGROUND OF THE INVENTION

1. Field of the Invention

The present invention relates to a small marine vessel including an outboard motor that can change an action position of a thrust force.

2. Description of the Related Art

A relatively small marine vessel such as a planing boat includes an outboard motor as a propulsion device. The outboard motor is attached to a stern of a hull so as to rotate about a tilt axis extending along a left-right direction of the hull. The outboard motor rotates (tilts up) such that an upper portion of the outboard motor moves forward and downward and a lower portion of the outboard motor moves rearward and upward about the tilt axis, or rotates (trims in) such that the upper portion moves rearward and downward and the lower portion moves forward and upward about the tilt axis (see, for example, Japanese Patent Application Laid-Open No. H01-317893).

In such a marine vessel, an action angle of a thrust force generated by a propeller of the outboard motor is changed by the tilting up or trimming in the outboard motor. For example, to maintain planing, the action angle of the thrust force is changed such that a bow is lowered by trimming in the outboard motor. In this manner, a posture of the hull can be controlled by the outboard motor being tilted up or trimmed in.

However, an action position of the thrust force does not change in the left-right direction of the hull even if the outboard motor is tilted up or trimmed in, and thus, the tilting-up or trimming-in of the outboard motor does not contribute to a change in yaw of the marine vessel, that is, an improvement in the turning performance of the marine vessel. The reason why the movement of the outboard motor is mainly limited to the tilting-up and the trimming-in is that an internal combustion engine is conventionally used as a power source of the outboard motor, and it is difficult to tilt the outboard motor in a direction other than a certain direction in order to establish circulation of lubricating oil in the internal combustion engine.

As a way for achieving sustainable development goals (SDGs) proposed in recent years, implementation of carbon-free of transportation has been promoted, and replacement of a power source of a marine vessel from the internal combustion engine to an electric motor has been studied. Since the electric motor does not require lubricating oil, the restriction on the movement of the outboard motor is reduced in the case of using the electric motor as the power source as compared with the case of using the internal combustion engine as the power source, and it is considered that there is room for the movement of the outboard motor to more actively contribute to maneuverability of the marine vessel.

SUMMARY OF THE INVENTION

Preferred embodiments of the present invention provide outboard motors that are each able to more actively contribute to the maneuverability of a marine vessel.

According to a preferred embodiment of the present invention, a small marine vessel includes a hull and at least one outboard motor attached to the hull, wherein the at least one outboard motor is attached to the hull to be rotatable about a first axis extending along a front-rear direction of the hull and to be movable in an up-down direction of the hull.

According to another preferred embodiment of the present invention, a small marine vessel includes a hull and at least one outboard motor attached to the hull, wherein the at least one outboard motor includes an electric motor as a power source, and the least one outboard motor is attached to the hull to be rotatable about a first axis extending along a front-rear direction of the hull.

According to the above configuration, the outboard motor can be not only rotated about a tilt axis extending along a left-right direction of the hull but also rotated about the first axis extending along a front-rear direction of the hull. Therefore, it is possible to change an action position of a thrust force generated by the propeller of the outboard motor in the left-right direction of the hull to actively change the yaw of the marine vessel. That is, it is possible to more actively contribute the movement of the outboard motor to the maneuverability of the marine vessel.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

Figure 1A:
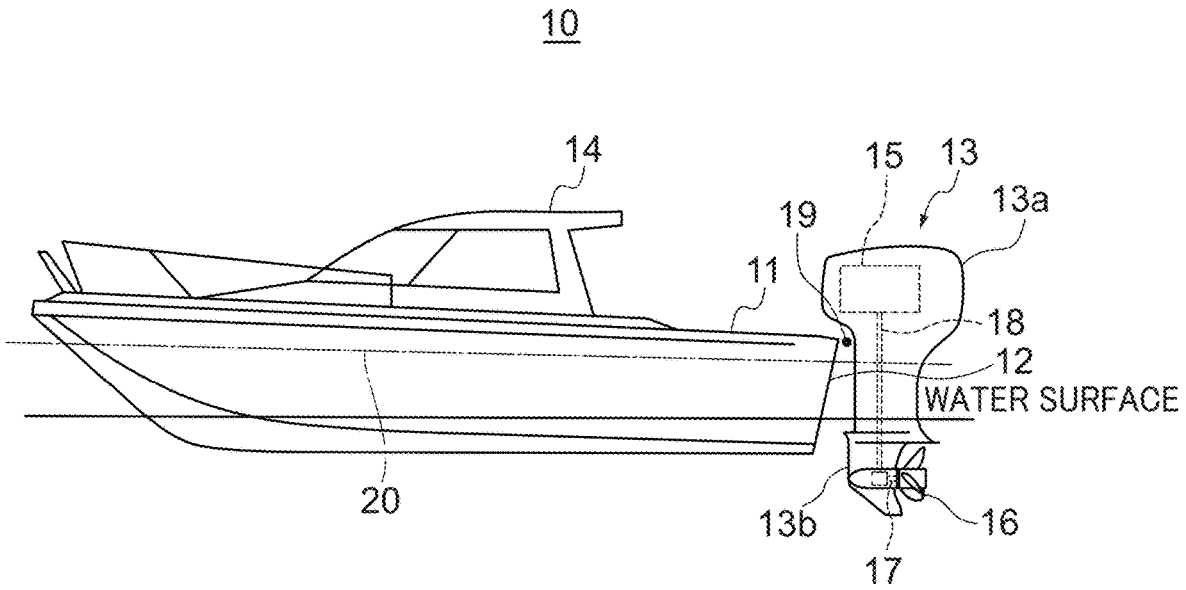
FIGS. 1A and 1B are views schematically illustrating a configuration of a small marine vessel according to a first preferred embodiment of the present invention.
Figure 1B:
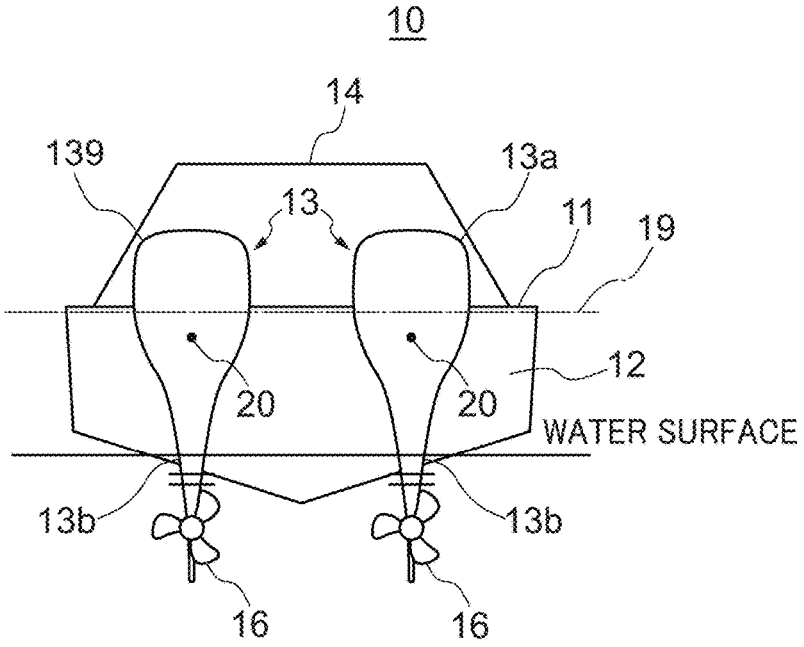

FIGS. 1A and 1B are views schematically illustrating a configuration of a small marine vessel 10 according to a first preferred embodiment of the present invention. FIG. 1A illustrates the small marine vessel 10 when viewed from the side, and FIG. 1B illustrates the small marine vessel 10 when viewed from the rear.

In FIGS. 1A and 1B, the marine vessel 10, which is a small marine vessel, is, for example, a planing boat, and includes a hull 11 and at least one, for example in the present preferred embodiment, two outboard motors 13 as propulsion devices attached to a stern 12 of the hull 11. A cabin 14 also serving as a cockpit is disposed on the hull 11. Although the marine vessel 10 in FIGS. 1A and 1B is assumed to be a planing boat, the marine vessel 10 is not limited to a planing boat, and may be, for example, a relatively small marine vessel of a displacement type.

The outboard motor 13 includes an electric motor 15 as a power source. The electric motor 15 is disposed in an upper portion 13*a* of the outboard motor 13. Moreover, the outboard motor 13 includes a propeller 16 disposed in a lower portion 13*b*, a propeller shaft 17 configured to rotate the propeller 16, and a drive shaft 18 configured to transmit a driving force of the electric motor 15 to the propeller shaft 17. The outboard motor 13 applies a thrust force to the marine vessel 10 by the propeller 16 rotated by the driving force of the electric motor 15.

The outboard motor 13 is provided with a steering mechanism (not illustrated), and the steering mechanism swings the outboard motor 13 in a left-right direction of the hull 11 (hereinafter, "of the hull 11" is omitted and simply referred to as the "left-right direction") with respect to the hull 11 to adjust an acting direction of the thrust force generated by the propeller 16 of the outboard motor 13 to the left and right.

Each of the outboard motors 13 is attached to the stern 12 of the hull 11 in a state of being rotatable about a roll axis 20 (first axis) extending in a front-rear direction of the hull 11 (hereinafter, "of the hull 11" is omitted and simply referred to as the "front-rear direction"). The roll axis 20 corresponds to each of the two outboard motors 13, and one outboard motor 13 rotates about its corresponding roll axis 20 independently of the other outboard motor 13 rotating about its corresponding roll axis 20.

The outboard motor 13 is attached to the stern 12 of the hull 11 in a state of being rotatable about a tilt axis 19 (second axis) extending in the left-right direction. Each of the outboard motors 13 is configured to rotate counterclockwise about the tilt axis 19 in FIG. 1A such that the upper portion 13*a* moves forward and downward of the hull 11 and the lower portion 13*b* moves rearward and upward of the hull 11. Each of the outboard motors 13 is configured to rotate clockwise about the tilt axis 19 in FIG. 1A such that the upper portion 13*a* moves rearward and downward of the hull 11 and the lower portion 13*b* moves forward and upward of the hull 11. Hereinafter, with respect to the rotation of the outboard motor 13, the former rotation is referred to as "tilting-up", and the latter rotation is referred to as "trimming-in".

Figure 2A:
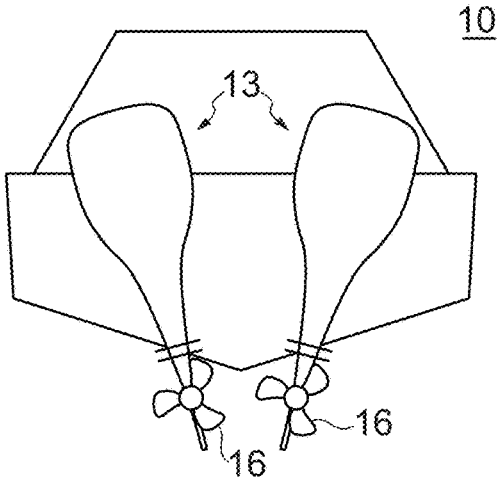
FIGS. 2A to 2C are views for describing a case where each of the outboard motors rotates about a corresponding roll axis.
Figure 2B:
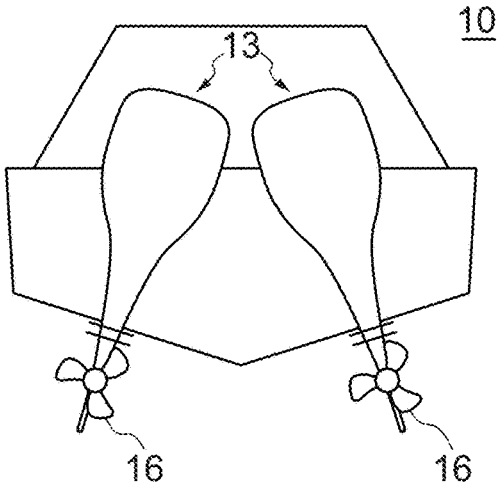
Figure 2C:
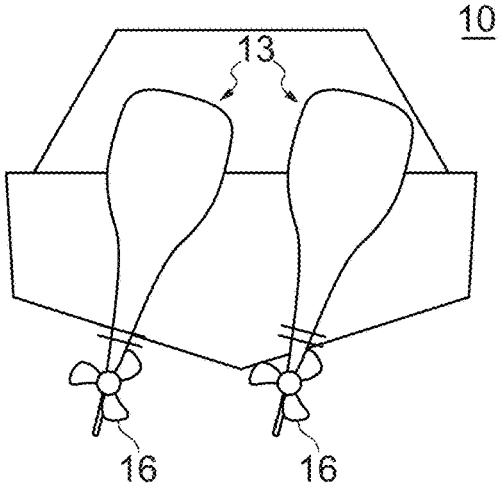

FIGS. 2A to 2C are views for describing a case where each of the outboard motors 13 rotates about its corresponding roll axis 20. FIGS. 2A to 2C illustrate the marine vessel 10 when viewed from the rear, wherein it is assumed that each of the outboard motors 13 is neither tilted up nor trimmed in.

For example, as illustrated in FIG. 2A, each of the outboard motors 13 can rotate about its own roll axis 20 such that propellers 16 provided in the respective outboard motors move closer to each other. In this case, a position where the thrust force generated by each of the outboard motors 13 is generated is closer to the center of the hull 11 in the left-right direction, and thus, straight traveling performance of the marine vessel 10 is improved during sailing with one motor, for example, when one outboard motor 13 fails and sailing is performed only with the other outboard motor 13.

As illustrated in FIG. 2B, each of the outboard motors 13 can rotate about its own roll axis 20 such that propellers 16 provided in the respective outboard motors are spaced farther apart from each other. In this case, a head-turning characteristic at the time of turning on the spot in which the marine vessel 10 rotates in a yaw direction without moving forward and rearward is improved.

Figure 3A:
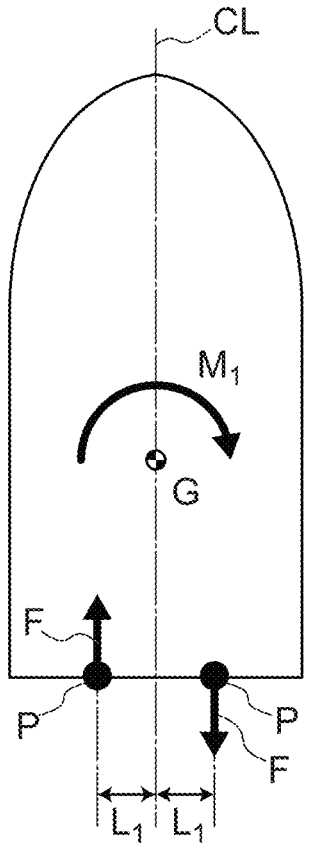
FIGS. 3A and 3B are views for describing why a head-turning characteristic is able to be improved when the marine vessel performs turning on the spot.
Figure 3B:
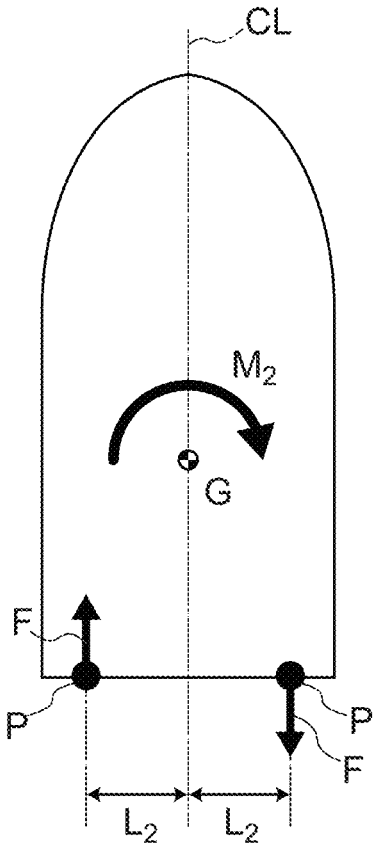

FIGS. 3A and 3B are views for describing why the head-turning characteristic is able to be improved when the marine vessel 10 performs turning on the spot. In each of FIGS. 3A and 3B, a line passing through the center of the hull 11 in the left-right direction and extending in the front-rear direction is referred to as a center line CL, and action points P at which thrust forces F of the respective outboard motors 13 act on the marine vessel 10 are indicated by black circles. In FIGS. 3A and 3B, the thrust force F to move the marine vessel 10 forward acts on the action point P on a port side, and the thrust force F to move the marine vessel 10 rearward acts on the action point P on a starboard side, so that the marine vessel 10 performs the turning on the spot toward the starboard side.

In a case where the propellers 16 of the outboard motors 13 are spaced farther apart from each other (FIG. 3B), a distance $L_2$ in the left-right direction from each of the action points P to the center line CL is larger than a distance $L_1$ in the left-right direction from each of the action points P to the center line CL in a case where each of the outboard motors 13 does not rotate about the roll axis 20 (FIG. 3A). As a result, regarding a yaw moment about a center of gravity G caused by the respective thrust forces F, a yaw moment $M_2$ in a case where each of the outboard motors 13 rotates about the roll axis 20 is larger than a yaw moment $M_1$ in a case where each of the outboard motors 13 does not rotate about the roll axis 20. Therefore, when the propellers 16 of the outboard motors 13 are rotated about the roll axes 20 so as to be spaced farther apart from each other at the time of performing turning on the spot, the head-turning characteristic of the marine vessel 10 is improved.

Further, as illustrated in FIG. 2C, each of the outboard motors 13 is able to turn about their roll axis 20 such that the respective propellers 16 move toward the port side (in the same direction). In this case, the turning performance of the marine vessel 10 to the starboard side is improved.

Figure 4A:
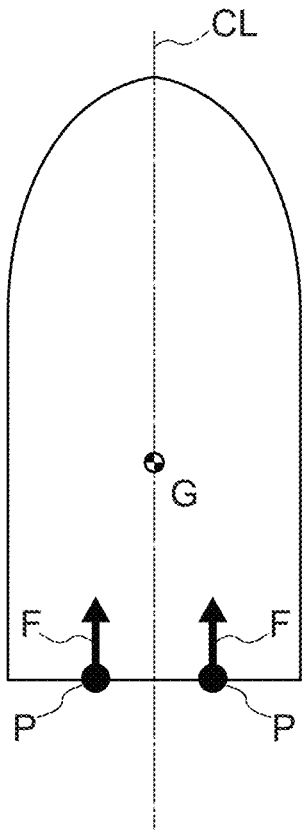
FIGS. 4A and 4B are views for describing why the turning performance of the marine vessel is able to be improved.
Figure 4B:
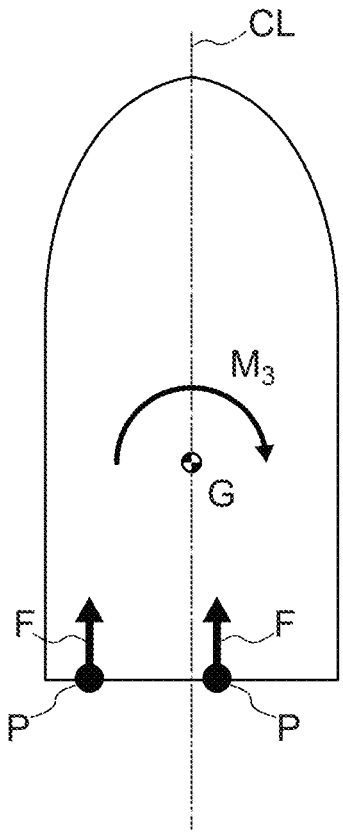

FIGS. 4A and 4B are views for describing why the turning performance of the marine vessel 10 is able to be improved. In each of FIGS. 4A and 4B, the thrust forces F of the same magnitude that move the marine vessel 10 forward act on the action point P on the port side and the action point P on the starboard side.

When the respective outboard motors 13 do not rotate about the roll axis 20 (FIG. 4A), distances from the respective action points P to the center line CL in the left-right direction become equal. Therefore, a yaw moment about the center of gravity G caused by the thrust force F acting on the action point P on the port side and a yaw moment about the center of gravity G caused by the thrust force F acting on the action point P on the starboard side cancel each other, and as a result, the yaw moment about the center of gravity G caused by the respective thrust forces F becomes zero.

On the other hand, when both of the propellers 16 of the respective outboard motors 13 move toward the port side (FIG. 4B), a distance in the left-right direction from the action point P on the port side to the center line CL is larger than a distance in the left-right direction from the action point P on the starboard side to the center line CL. Therefore, a yaw moment about the center of gravity G generated due to the thrust force F acting on the action point P on the port side is larger than a yaw moment about the center of gravity G generated due to the thrust force F acting on the action point P on the starboard side. As a result, a yaw moment $M_3$ about the center of gravity G that facilitates turning of the marine vessel 10 to the starboard side is generated due to the respective thrust forces F. Therefore, when both of the propellers 16 of the respective outboard motors 13 are rotated about their roll axes 20 so as to move toward the port side, the turning performance of the marine vessel 10 toward the starboard side is improved.

Note that the outboard motors 13 may rotate about their roll axes 20 such that the respective propellers 16 move toward the starboard side. In this case, the turning performance of the marine vessel 10 toward the port side is improved.

According to the present preferred embodiment, each of the outboard motors 13 is able to be independently rotated about their roll axis 20. Therefore, positions of the action points P of the thrust forces F generated by the propellers 16 of the respective outboard motors 13 can be changed in the left-right direction of the marine vessel 10 to actively change the yaw of the marine vessel 10. That is, the movement of each of the outboard motors 13 more actively contributes to the maneuverability of the marine vessel 10.

Since the power source of each of the outboard motors 13 is the electric motor 15 in the present preferred embodiment, it is unnecessary to consider an influence of tilting of the outboard motor 13 on the circulation of lubricating oil, and a rotation amount (roll amount) of each of the outboard motors 13 about the roll axis 20 can be increased. Therefore, the positions of the action points P of the thrust forces F can be changed more greatly in the left-right direction of the marine vessel 10, and the yaw of the marine vessel 10 can be further actively changed.

Moreover, according to the present preferred embodiment, the yaw of the marine vessel 10 can be actively changed by rotating each of the outboard motors 13 about their roll axis 20. Therefore, it is unnecessary to increase an output of the electric motor 15 of each of the outboard motors 13 more than necessary in order to improve the head-turning characteristic when turning on the spot. Further, it is unnecessary to dispose the outboard motors 13 to be greatly spaced apart from each other in the left-right direction. Therefore, the outboard motors 13 can be downsized, and the degree of freedom of the layout of the outboard motors 13 is able to be improved.

Figure 5A:
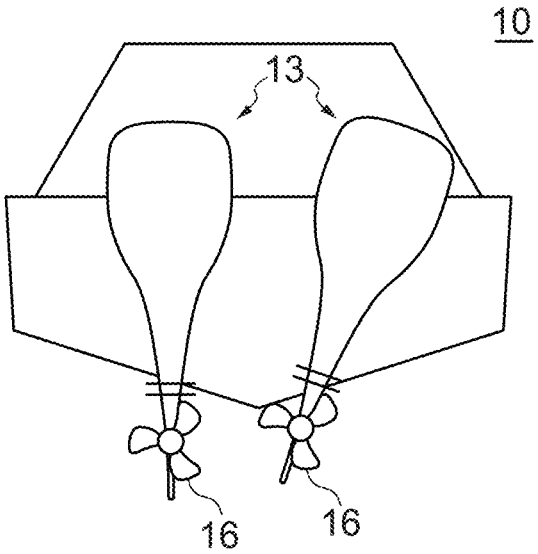
FIGS. 5A and 5B are views for describing a modification of a case where each of the outboard motors rotates about a corresponding roll axis.
Figure 5B:
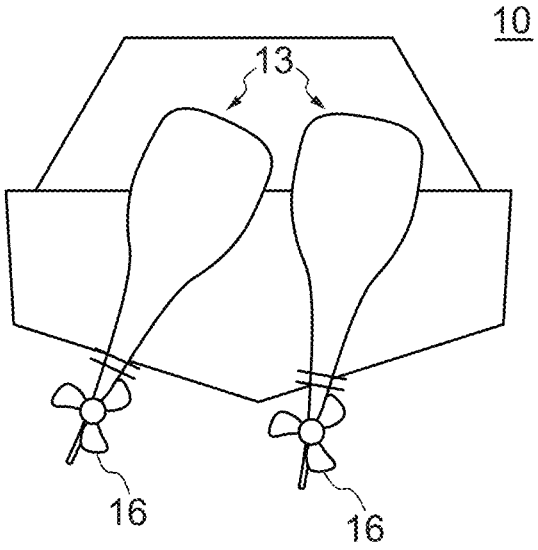

Note that in each of the cases illustrated in FIGS. 2A to 2C, absolute values of the roll amounts about the roll axes 20 of the left and right outboard motors 13 are the same. Instead, only one outboard motor 13 may be rotated about its corresponding roll axis 20 as illustrated in FIG. 5A. Alternatively, as illustrated in FIG. 5B, the absolute values of the roll amounts about the roll axes 20 of the left and right outboard motors 13 may be made different.

Next, a second preferred embodiment of the present invention will be described. The second preferred embodiment is different from the first preferred embodiment in that each of the outboard motors 13 moves also in an up-down direction of the hull 11 (hereinafter, "of the hull 11" is omitted and simply referred to as the "up-down direction"), but is basically the same as the first preferred embodiment described above in terms of the other configurations and actions thereof. The configurations and actions thereof overlapping with those of the first preferred embodiment will not be described. Hereinafter, configurations and actions of the second preferred embodiment, different from those of the first preferred embodiment, will be described.

Figure 6A:
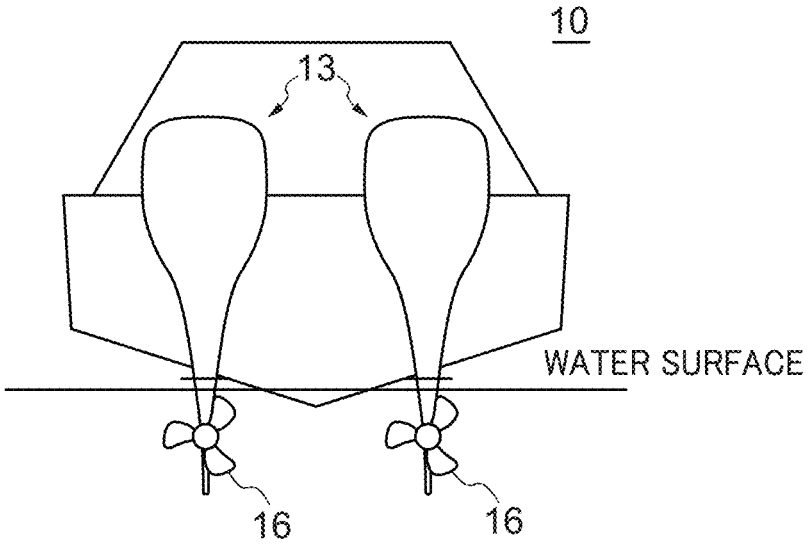
FIGS. 6A and 6B are views for describing how each propeller comes closer to a water surface when each of the outboard motors rotates about a corresponding roll axis.
Figure 6B:
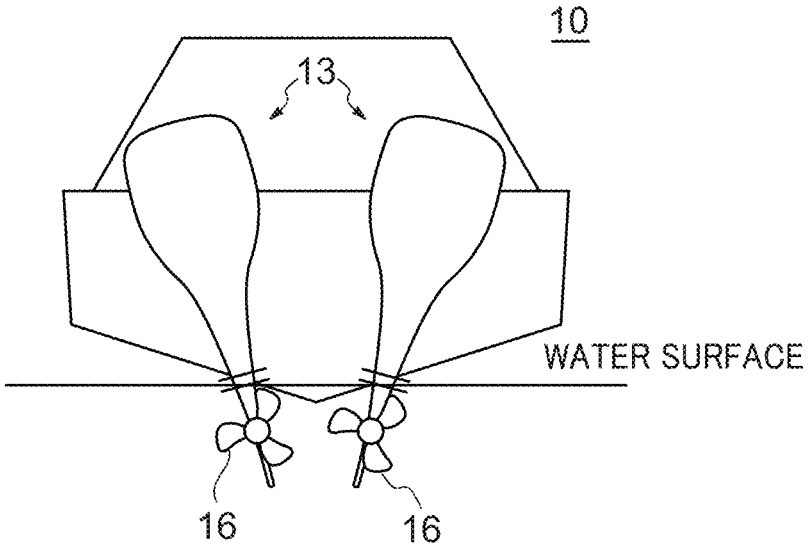

In a case where the marine vessel 10 as a planing boat sails at a high speed, lift acting on a vessel bottom is generated, and the marine vessel 10 shifts to a planing state. In this case, the hull 11 rises, which brings the draft shallower and brings the propellers 16 closer to a water surface. Then, when the outboard motors 13 rotate about their respective roll axes 20 (FIG. 6B), the propellers 16 move upward with respect to the hull 11 due to the rotation, and the propellers 16 come even closer to the water surface as compared with a case where the outboard motors 13 do not rotate about their respective roll axes 20 (FIG. 6A). Therefore, there is a possibility that cavitation occurs in the propellers 16 or air entrainment occurs in which the propellers 16 take in air above the water surface. To cope with this, the outboard motors 13 are configured to be movable in the up-down direction in the present preferred embodiment.

Figure 7A:
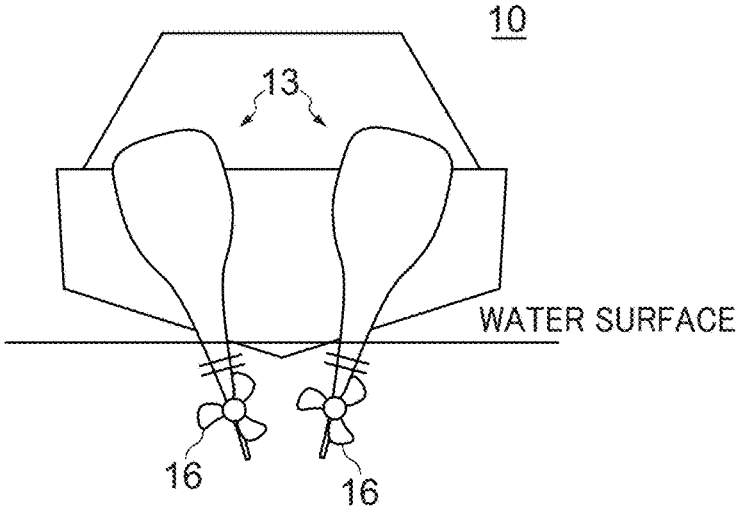
FIGS. 7A to 7C are views for describing a case where each of the outboard motors is rotated about a corresponding roll axis and moved downward with respect to a hull according to a second preferred embodiment of the present invention.
Figure 7B:
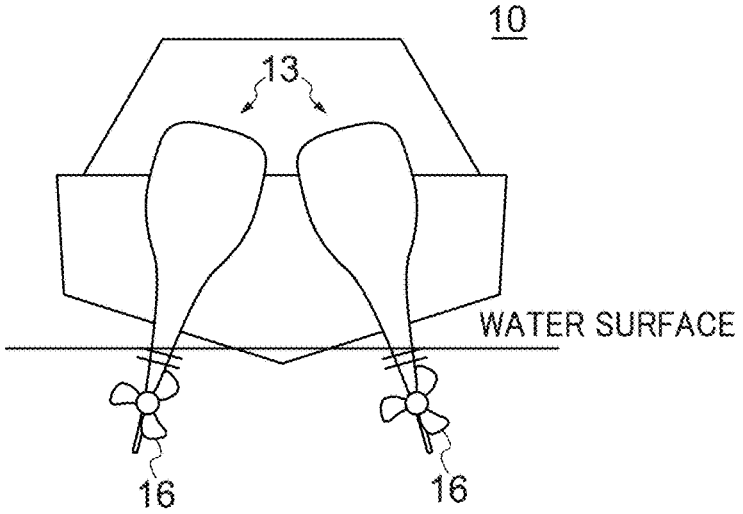
Figure 7C:
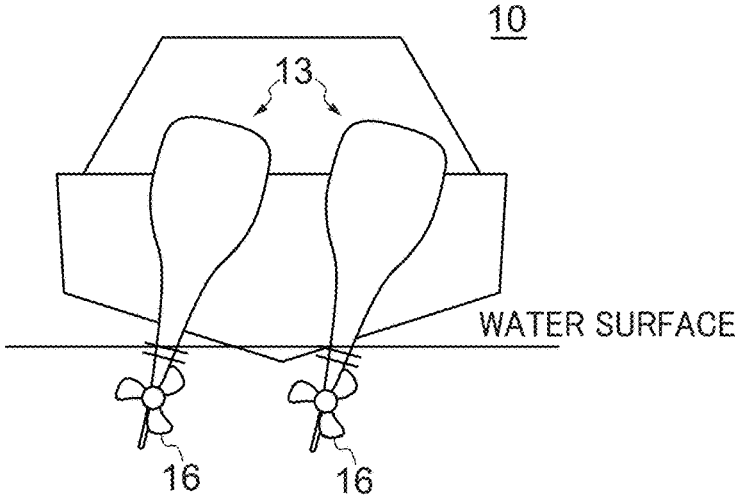

FIGS. 7A to 7C are views for describing a case where each of the outboard motors 13 is rotated about their corresponding roll axis 20 and moved downward with respect to the hull 11. FIGS. 7A to 7C illustrate the marine vessel 10 when viewed from the rear, wherein it is assumed that each of the outboard motors 13 is neither tilted up nor trimmed in.

For example, as illustrated in FIG. 7A, when each of the outboard motors 13 is rotated about their roll axis 20 such that the respective propellers 16 move closer to each other, each of the outboard motors 13 is able to be moved downward so as to cancel the upward movement of each of the propellers 16 caused by the rotation about the roll axis 20.

Further, as illustrated in FIG. 7B, when each of the outboard motors 13 is rotated about their roll axis 20 such that the respective propellers 16 are spaced farther apart from each other, each of the outboard motors 13 is able to be moved downward so as to cancel the upward movement of each of the propellers 16 caused by the rotation about the roll axis 20.

Moreover, as illustrated in FIG. 7C, when each of the outboard motors 13 is rotated about their roll axis 20 such that the respective propellers 16 move toward the port side, each of the outboard motors 13 is able to be moved downward so as to cancel the upward movement of each of the propellers 16 caused by the rotation about the roll axis 20. Even when each of the outboard motors 13 is rotated about the roll axis 20 corresponding to each of the outboard motors such that the respective propellers 16 move toward the starboard side, each of the outboard motors 13 can be moved downward so as to cancel the upward movement of each of the propellers 16 caused by the rotation about the roll axis 20.

According to the present preferred embodiment, since each of the outboard motors 13 is able to be moved downward in response to the rotation of each of the outboard motors 13 about their roll axis 20, the upward movement of each of the propellers 16 caused by the rotation about the roll axis 20 is canceled which prevents each of the propellers 16 from being closer to the water surface. Therefore, it is possible to prevent the occurrence of cavitation and the occurrence of air entrainment in each of the propellers 16.

Further, in the present preferred embodiment, the rotation about the roll axis 20 and the movement in the up-down direction of the outboard motor 13 are performed independently. In this case, two actuators including an actuator for the rotation and an actuator for the movement in the up-down direction are required. Therefore, in order to reduce the number of actuators, the marine vessel 10 may be provided with a link mechanism that tilts the outboard motor 13 toward the left-right direction with respect to the up-down direction along with the movement of the outboard motor 13 in the up-down direction.

Figure 8A:
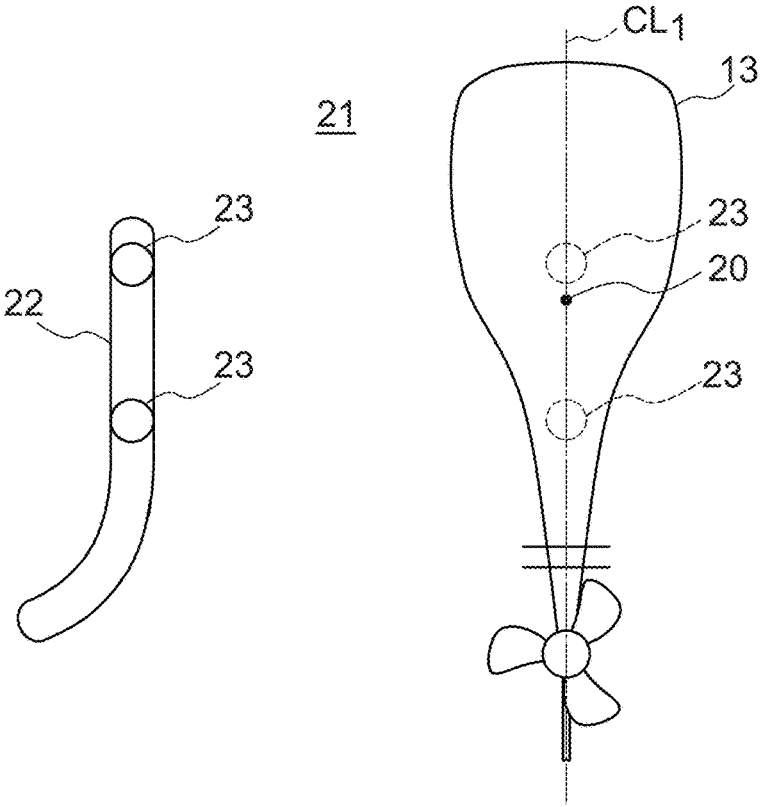
FIGS. 8A and 8B are views for describing a mechanism of a link mechanism configured to tilt the outboard motor toward left/right with respect to an up-down direction along with movement of the outboard motor in the up-down direction.
Figure 8B:
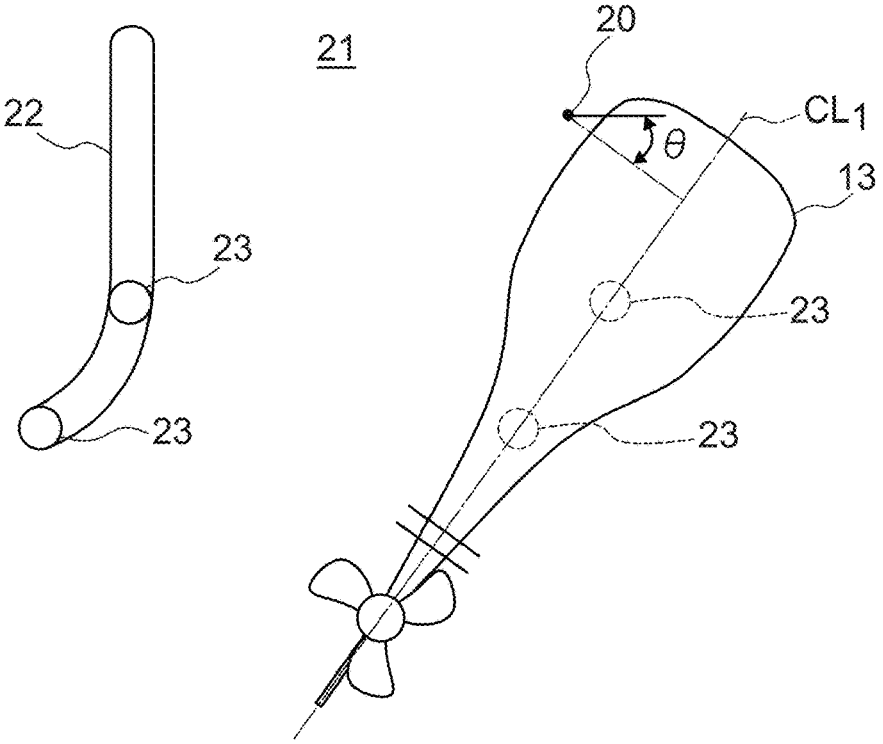

FIGS. 8A and 8B are views for describing a mechanism of a link mechanism 21 configured to tilt the outboard motor 13 toward the left/right with respect to the up-down direction along with the movement of the outboard motor 13 in the up-down direction. FIGS. 8A and 8B illustrate the marine vessel 10 when viewed from the rear.

The link mechanism 21 includes a curved or J-shaped guide rail 22 and two cylindrical guides 23 that are loosely engaged with the guide rail 22 and are configured to be movable along the guide rail 22. The guide rail 22 is provided on the stern 12 of the hull 11 so that a linear portion in an upper portion of the guide rail 22 extends along the up-down direction, and a curved portion in a lower portion of the guide rail 22 is offset from the upper linear portion in the left-right direction as it extends downward. Further, each of the guides 23 is provided on the front side (which faces the stern 12) of the outboard motor 13 so as to protrude forward (toward the marine vessel 10 side). Furthermore, the guides 23 are arranged along the center line $CL_1$ extending in the up-down direction of the outboard motor 13.

In the link mechanism 21, as illustrated in FIG. 8A, the guides 23 are loosely engaged with the linear portion in the upper portion of the guide rail 22 before the outboard motor 13 moves downward, and thus, the respective guides 23 are positioned along the up-down direction. The center line $CL_1$ of the outboard motor 13 is not tilted with respect to the up-down direction, and thus, the outboard motor 13 is also not tilted with respect to the up-down direction. On the other hand, as illustrated in FIG. 8B, when the outboard motor 13 moves downward, the lower guide 23 is loosely engaged with the curved portion in the lower portion of the guide rail 22, and thus, the lower guide 23 is offset more greatly in the left-right direction than the upper guide 23. As a result, the center line $CL_1$ of the outboard motor 13 is tilted toward the left-right direction with respect to the up-down direction, and the outboard motor 13 is also tilted toward the left-right direction with respect to the up-down direction.

In the link mechanism 21, the outboard motor 13 can be tilted toward the left-right direction with respect to the up-down direction along with the movement of the outboard motor 13 in the up-down direction. Therefore, it is possible to change the positions of the action points P of the thrust forces F generated by the propellers 16 in the left-right direction, thus actively changing the yaw of the marine vessel 10. Further, in the link mechanism 21, the outboard motor 13 can be tilted toward the left-right direction with respect to the up-down direction only by the actuator for moving the outboard motor 13 in the up-down direction, and thus, the number of actuators to be used is reduced.

Note that in the link mechanism 21, the outboard motor 13 does not rotate about the roll axis 20. However, an angle θ (rotation angle about the roll axis 20) formed by a normal line extending from the roll axis 20 to the center line CIA_ and the left-right direction is larger than 0° when the outboard motor 13 is tilted toward the left-right direction (in FIG. 8B, the upper portion 13*a* of the outboard motor 13 is tilted toward the right) with respect to the up-down direction, and thus, the outboard motor 13 substantially rotates about the roll axis 20.

Further, the guide rail 22 is provided on the stern 12 of the hull 11 such that the linear portion in the upper portion is disposed along the up-down direction, but the linear portion in the upper portion may be slightly tilted toward the left-right direction with respect to the up-down direction.

Figure 9A:
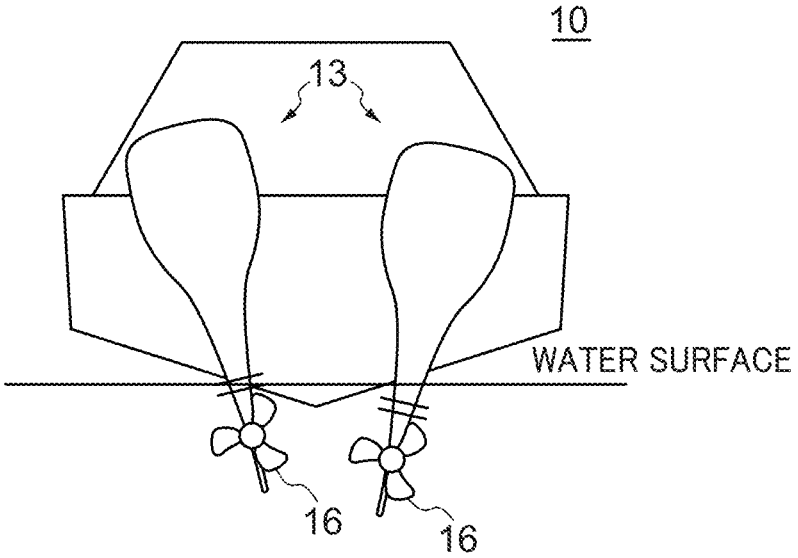
FIGS. 9A and 9B are views for describing a modification of a case where each of the outboard motors is rotated about a corresponding roll axis and moved downward with respect to a hull.

In each of the cases illustrated in FIGS. 7A to 7C, the amount of downward movement of the left outboard motor 13 and the amount of downward movement of the right outboard motor 13 are the same. However, one outboard motor 13 may be configured to be movable in the up-down direction independently of the other outboard motor 13, and the amount of movement of one outboard motor 13 in the downward direction may be different from the amount of movement of the other outboard motor 13 in the downward direction. For example, as illustrated in FIG. 9A, the amount of downward movement of the outboard motor 13 on the starboard side may be larger than the amount of downward movement of the outboard motor 13 on the port side. In this case, the propeller 16 on the starboard side sinks deeper than the propeller 16 on the port side. Therefore, due to a difference in water pressure, the thrust force F on the starboard side becomes larger than the thrust force F on the port side, which generates a yaw moment that turns the marine vessel 10 to the port side.

Figure 9B:
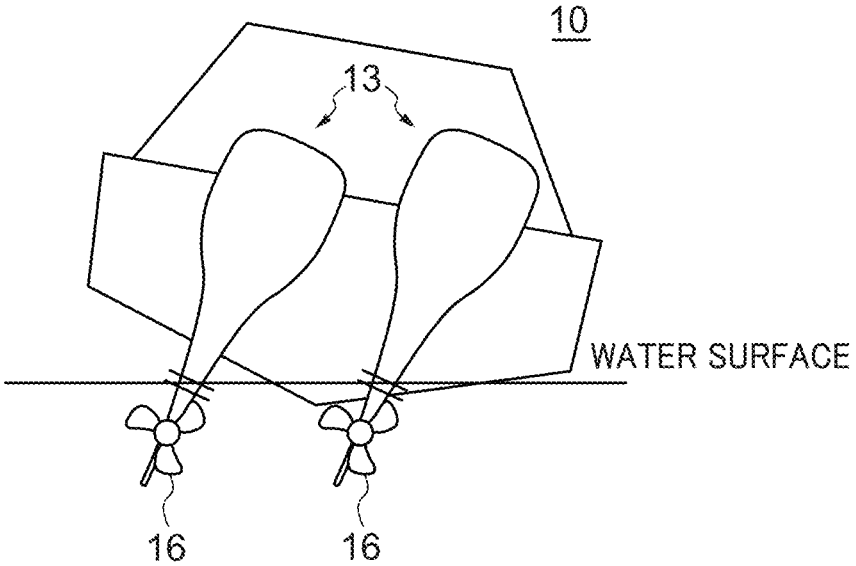

When the marine vessel 10 turns, the hull 11 rolls so that one outboard motor 13 out of the left and right outboard motors 13 is lifted, and the propeller 16 of the lifted outboard motor 13 comes closer to the water surface. In this case, as illustrated in FIG. 9B, the upward movement of the propeller 16 by the roll of the hull 11 is canceled by the lifted outboard motor 13 being moved downward, and the propellers 16 are prevented from being close to the water surface.

A third preferred embodiment of the present invention will be described. The third preferred embodiment is different from the first preferred embodiment in that each of the outboard motors 13 is not only rotated about the roll axis 20 but also rotated about the tilt axis 19, but is basically the same as the first preferred embodiment described above in terms of the other configurations and actions thereof. The configurations and actions thereof overlapping with those of the first preferred embodiment will not be described. Hereinafter, configurations and actions thereof of the third preferred embodiment, different from those of the first preferred embodiment, will be described.

Figure 10A:
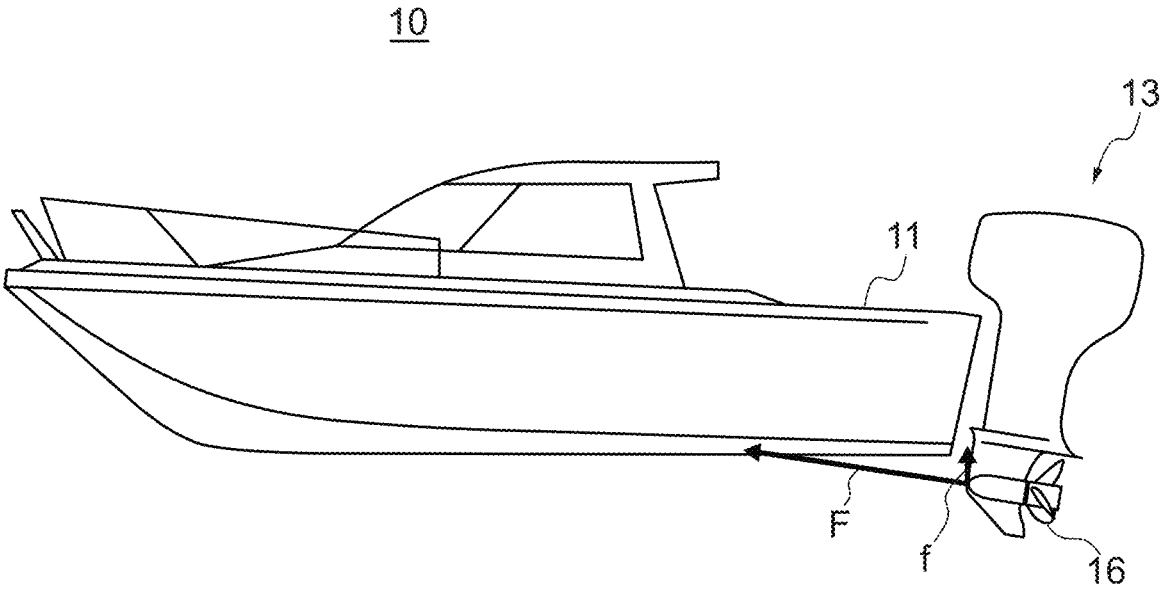
FIGS. 10A and 10B are views for describing an effect caused when the outboard motor is rotated about a tilt axis in the marine vessel.
Figure 10B:
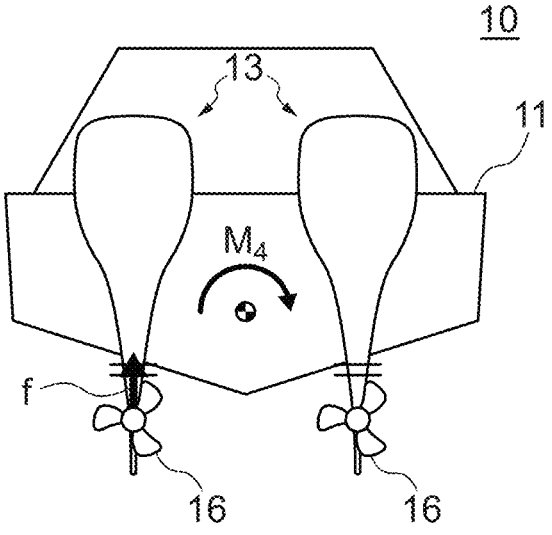

FIGS. 10A and 10B are views for describing an effect caused when the outboard motor 13 is rotated about the tilt axis 19 in the marine vessel 10. In the present preferred embodiment, it is assumed that only the outboard motor 13 on one side, for example, only the outboard motor 13 on the port side is tilted up or trimmed in, and the outboard motor 13 on the starboard side is not rotated about the tilt axis 19. Note that the right outboard motor 13 is not illustrated in FIG. 10A.

When the outboard motor 13 on the port side is trimmed in, the thrust force F on the port side acts obliquely upward on the hull 11, and an upward component force f is generated (FIG. The component force f lifts the port side of the hull 11. That is, a roll moment $M_4$ to tilt the hull 11 to the starboard side is generated by the component force f (FIG. 10B). Further, when only the outboard motor 13 on the port side is tilted up, the thrust force F on the port side acts obliquely downward on the hull 11, and a downward component force is generated, and thus, a roll moment to tilt the hull 11 to the port side is generated.

Although the outboard motor 13 on the starboard side does not rotate about the tilt axis 19 in FIGS. 10A and 10B, the outboard motor 13 on the starboard side may also rotate about the tilt axis 19. In such a case, it is necessary to make the component force f of the thrust force F on the port side different from a component force f of the thrust force F on the starboard side in order to generate the roll moment $M_4$. Therefore, it is necessary to configure the outboard motor 13 on the starboard side to be rotatable about the tilt axis 19 independently of the outboard motor 13 on the port side, and rotate the outboard motor 13 on the starboard side such that a rotation angle about the tilt axis 19 of the outboard motor 13 on the starboard side is different from a rotation angle about the tilt axis 19 of the outboard motor 13 on the port side.

Figure 11A:
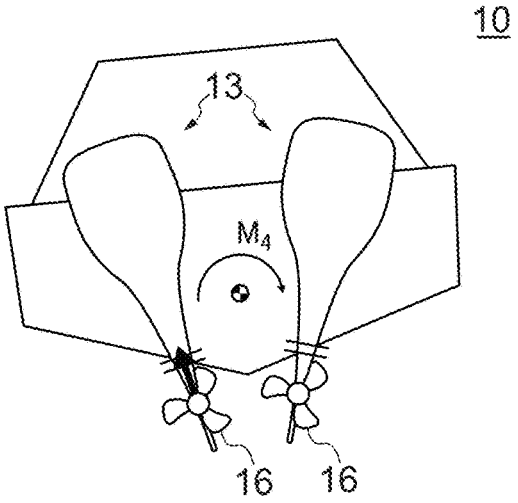
FIGS. 11A to 11C are views for describing a case where each of the outboard motors is rotated about a corresponding roll axis and the outboard motor on a port side is trimmed in according to a third preferred embodiment of the present invention.
Figure 11B:
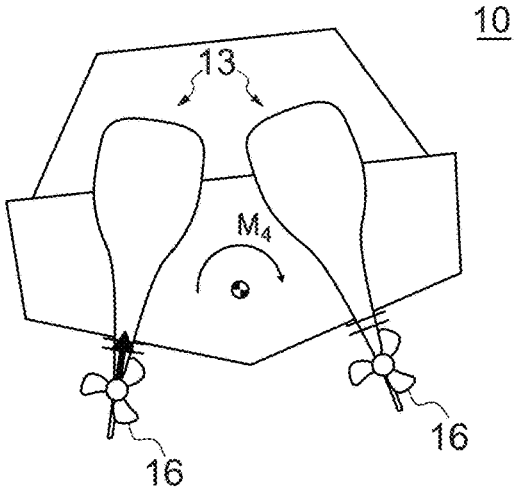
Figure 11C:
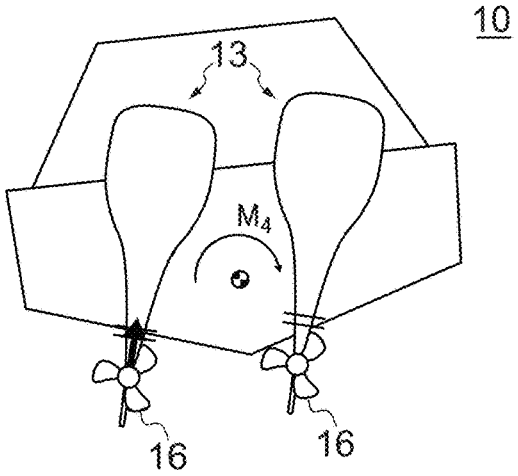

FIGS. 11A to 11C are views for describing a case where each of the outboard motors 13 is rotated about its corresponding roll axis 20 and the outboard motor 13 on the port side is trimmed in. FIGS. 11A to 11C illustrate the marine vessel 10 when viewed from the rear.

For example, as illustrated in FIG. 11A, each of the outboard motors 13 is rotated about their respective roll axis such that the respective propellers 16 move closer to each other. At this time, an interval between the action points P of the thrust forces F is narrowed, which makes it difficult for the hull 11 to balance in the left-right direction, and the hull 11 is likely to tilt toward one side. In this case, the outboard motor 13 on one side is trimmed in to generate the roll moment $M_4$ so as to cancel the tilt. FIG. 11A illustrates a case where the hull 11 tilts toward the port side. In this case, the outboard motor 13 on the port side is trimmed in to generate the roll moment $M_4$ that causes the hull 11 to be tilted toward the starboard side.

Further, as illustrated in FIG. 11B, each of the outboard motors 13 is rotated about their corresponding roll axis 20 such that the propellers 16 of the respective outboard motors are spaced farther apart from each other so as to perform turning on the spot. At this time, the resistance of water acts on the side of the hull 11 and generates a roll moment, and thus the hull 11 is likely to tilt toward one side. In this case, the outboard motor 13 on one side is trimmed in to generate the roll moment $M_4$ so as to cancel the roll moment generated due to the resistance of water. FIG. 11B illustrates a case where the resistance of water acts on the starboard side of the hull 11 so that the hull 11 tilts toward the port side when turning on the spot is performed toward the starboard side. In this case, the outboard motor 13 on the port side is trimmed in to generate the roll moment $M_4$ to tilt the hull 11 toward the starboard side.

Moreover, when the marine vessel 10 turns to the starboard side, in order to generate a yaw moment that facilitates turning to the starboard side, each of the outboard motors 13 is turned about their respective roll axis 20 such that the propellers 16 of the respective outboard motors move toward the port side as illustrated in FIG. 11C. At this time, when the marine vessel 10 sails at a low speed, the marine vessel 10 behaves like a displacement type vessel, and thus, the hull 11 is likely to tilt toward the port side. In this case, the outboard motor 13 on the port side is trimmed in to generate the roll moment $M_4$ to tilt the hull 11 toward the starboard side.

Note that in a case where the marine vessel 10 is traveling at a low speed, the hull 11 is likely to tilt toward the starboard side when each of the outboard motors 13 is rotated about their respective roll axis 20 such that the propellers 16 of the respective outboard motors move toward the starboard side when the marine vessel 10 turns to the port side. In this case, the outboard motor 13 on the starboard side is trimmed in to generate a roll moment to tilt the hull 11 toward the port side.

According to the present preferred embodiment, since the outboard motor 13 on the side of the hull 11 sinking into the water is trimmed in in response to a tilt toward one side of the hull 11, the roll moment $M_4$ that cancels the tilt is generated, and thus, the ride comfort is able to be improved.

Note that it is assumed that the rotation angle about the tilt axis 19 of the outboard motor 13 on the starboard side is different from the rotation angle about the tilt axis 19 of the outboard motor 13 on the port side in the present preferred embodiment, but these rotation angles may be the same. Further, each of the outboard motors 13 may be moved in the up-down direction as in the second preferred embodiment. In this case, amounts of downward movement of the left and right outboard motors 13 may be the same or different from each other.

Although preferred embodiments of the present invention have been described above, the present invention is not limited to the above-described respective preferred embodiments, and various modifications and changes can be made within the scope of the gist of the present invention.

For example, the outboard motor 13 of each of the above-described preferred embodiments includes the electric motor 15 as the power source. However, the outboard motor 13 may include, as the power source, for example, a rotary engine which is an internal combustion engine in which the circulation of lubricating oil is established even when the outboard motor 13 is greatly rotated about the roll axis 20, or a reciprocating engine that is able to suck up lubricating oil from an oil pan by a strainer even with a large tilt.

Although preferred embodiments of the present invention have been applied to the marine vessel 10 including the outboard motors 13, the present invention may be applied to a small marine vessel including at least one inboard/outboard motor.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A small marine vessel comprising:

a hull; and at least one outboard motor including a propeller and attached to the hull;

wherein the at least one outboard motor is attached to the hull to be rotatable about a first axis extending along a front-rear direction of the hull and to be movable in an up-down direction of the hull; and in response to the at least one outboard motor being rotated about the first axis causing an upward movement of the propeller in water, the at least one outboard motor is also moved downward to cancel the upward movement of the propeller.

2. The small marine vessel according to claim 1, wherein the at least one outboard motor includes a plurality of outboard motors each having the first axis extending along the front-rear direction of the hull;

each of the plurality of outboard motors is rotatable about the first axis; and among the plurality of outboard motors, one outboard motor is rotatable about the first axis independently of another outboard motor being rotatable about the first axis.

3. The small marine vessel according to claim 2, wherein each of the plurality of outboard motors includes a propeller; and each of the plurality of outboard motors is rotatable about the first axis such that the propellers of the plurality of outboard motors are spaced farther apart from each other.

4. The small marine vessel according to claim 3, wherein each of the plurality of outboard motors is movable in the down direction of the hull when each of the plurality of outboard motors rotates about the first axis such that the propellers of the plurality of outboard motors are spaced farther apart from each other.

5. The small marine vessel according to claim 2, wherein each of the plurality of outboard motors includes a propeller; and each of the plurality of outboard motors is rotatable about the first axis such that the propellers of the plurality of outboard motors move closer to each other.

6. The small marine vessel according to claim 5, wherein each of the plurality of outboard motors is movable in the downward direction of the hull when each of the plurality of outboard motors rotates about the first axis such that the propellers of the outboard motors move closer to each other.

7. The small marine vessel according to claim 2, wherein each of the plurality of outboard motors includes a propeller; and each of the plurality of outboard motors is rotatable about the first axis such that the propellers of the plurality of outboard motors move in a same direction with respect to a left-right direction of the hull.

8. The small marine vessel according to claim 7, wherein each of the plurality of outboard motors is movable in the down direction of the hull when each of the plurality of outboard motors rotates about the first axis such that the propellers of the plurality of outboard motors move in the same direction with respect to the left-right direction of the hull.

9. The small marine vessel according to claim 1, wherein the at least one outboard motor includes a plurality of outboard motors; and among the plurality of outboard motors, one outboard motor is movable in the up-down direction of the hull independently of another outboard motor being movable in the up-down direction.

10. The small marine vessel according to claim 9, wherein each of the plurality of outboard motors is rotatable about the first axis when moving in the up-down direction of the hull.

11. The small marine vessel according to claim 10, further comprising:

a J-shaped guide rail and a guide movable along the J-shaped guide rail, correspondingly to each of the outboard motors, and the guide rail is provided on the hull, and the guide is provided on the outboard motor.

12. The small marine vessel according to claim 1, wherein the at least one outboard motor is attached to the hull to be rotatable about a second axis extending along a left-right direction of the hull.

13. The small marine vessel according to claim 12, wherein the at least one outboard motor includes a plurality of outboard motors each having the second axis extending along the left-right direction of the hull;

each of the plurality of outboard motors is rotatable about the second axis; and among the plurality of outboard motors, one outboard motor is rotatable about the second axis independently of another outboard motor being rotatable about the second axis.

14. The small marine vessel according to claim 13, wherein when each of the plurality of outboard motors is rotatable about the second axis, a rotation angle of the one outboard motor about the second axis is different from a rotation angle of the another outboard motor about the second axis.

15. The small marine vessel according to claim 14, wherein each of the plurality of outboard motors includes a propeller; and each of the plurality of outboard motors is rotatable about the first axis such that the propellers of the plurality of outboard motors are spaced farther apart from each other.

16. The small marine vessel according to claim 14, wherein each of the plurality of outboard motors includes a propeller; and each of the plurality of outboard motors is rotatable about the first axis such that the propellers of the plurality of outboard motors move closer to each other.

17. The small marine vessel according to claim 14, wherein each of the plurality of outboard motors includes a propeller; and each of the plurality of outboard motors is rotatable about the first axis such that propellers of the plurality of outboard motors move in a same direction with respect to the left-right direction of the hull.

18. The small marine vessel according to claim 1, wherein the at least one outboard motor includes a power source including an electric motor or an internal combustion engine.

* * * * *